US005249552A

United States Patent [19]

Brooks

[11] Patent Number: 5,249,552

[45] Date of Patent: Oct. 5, 1993

[54] FUEL COMBUSTION EFFICIENCY

[75] Inventor: Douglas M. Brooks, Harringworth, Nr. Corby, Great Britain

[73] Assignee: Wribro Ltd., Douglas, Isle of Man

[21] Appl. No.: 828,908

[22] PCT Filed: May 23, 1990

[86] PCT No.: PCT/GB90/00803

§ 371 Date: Jan. 23, 1992

§ 102(e) Date: Jan. 23, 1992

[87] PCT Pub. No.: WO90/14516

PCT Pub. Date: Nov. 29, 1990

[30] Foreign Application Priority Data

May 26, 1989 [GB] United Kingdom ..... 8912592

[51] Int. Cl.[5] ..... F02B 75/12; F02M 27/00

[52] U.S. Cl. ..... 123/1; 431/4; 123/538; 44/354

[58] Field of Search ..... 123/1 R, 1 A, 538; 44/354; 431/2, 4

[56] References Cited

U.S. PATENT DOCUMENTS

| | | | |
|---|---|---|---|
| 2,231,605 | 2/1941 | Stephenson | 123/122 |
| 4,357,237 | 11/1982 | Sanderson | 123/538 |
| 4,454,850 | 6/1984 | Horvath | 123/1 A |
| 4,469,076 | 9/1984 | Wolff | 123/538 |
| 4,569,737 | 2/1986 | Sakata | 585/899 |
| 4,715,325 | 12/1987 | Walker | 123/1 A |
| 5,048,499 | 9/1991 | Daywalt | 123/1 A |
| 5,076,246 | 12/1991 | Onyszczuk | 123/538 |
| 5,092,303 | 3/1992 | Brown | 123/538 |
| 5,105,773 | 4/1992 | Cunningham et al. | 123/1 A |
| 5,113,803 | 5/1992 | Hollrah | 123/1 A |

FOREIGN PATENT DOCUMENTS

| | | |
|---|---|---|
| 63-61766 | 3/1988 | Japan . |
| 0814269 | 6/1959 | United Kingdom . |
| 1079698 | 8/1967 | United Kingdom . |

OTHER PUBLICATIONS

Automotive Engineering, vol. 93, No. 8, Aug. 1985, Warrendale, Pa. U.S.A.

*Primary Examiner*—E. Rollins Cross
*Assistant Examiner*—Erick Solis
*Attorney, Agent, or Firm*—Sughrue, Mion, Zinn, Macpeak & Seas

[57] ABSTRACT

An apparatus, for improving fuel combustion efficiency, comprises a fuel additive made from a formulation of metals as a plurality of identical cones (24), each of the cones being located within a magnetic field of a pair of permanent ferrite magnets (30) and the apparatus being locatable in a fuel line near the point of fuel combustion.

6 Claims, 2 Drawing Sheets

FUEL COMBUSTION EFFICIENCY

The present invention relates generally to improving fuel combustion efficiency and is more particularly concerned with apparatus which is capable of providing such an improvement.

It has been found that the efficiency of fuel combustion can be improved to a small extent, typically 3%, by the use of a fuel additive made from a formulation of metals including tin and lead. It has also been found that the efficiency of fuel combustion can be improved to a small extent, typically 1%, by the use of a magnet installed outside a fuel line near to the point of combustion. Neither of these effects by itself is particularly marked. Indeed, automobile manufacturers do not supply their automobiles with fuel additives or magnets for improving fuel combustion efficiency, even though automobile manufacturers would be expected to be keen for their automobiles to use less fuel and thus have lower running costs. It has therefore proved to be all the more surprising, and unexpected, that the use of a fuel additive and a magnet in close combination gives greatly improved fuel combustion efficiency, typically 10%, as a result of an unexplained but apparently synergistic reaction.

Apparatus according to the present invention, for improving the efficiency of fuel combustion, comprises a fuel additive made from a formulation of metals, and is characterised in that said fuel additive is located within the magnetic field of a magnet.

The fuel may be, for example, any grade of oil, petrol or diesel.

The introduction of the fuel additive may occur, for example, in a fuel storage tank or in a fuel line or both. The fuel storage tank may be formed of steel, in which case the chemical reaction may include the tank. Alternatively, the fuel storage tank may be formed of a plastics material, in which case the additive may be enveloped or otherwise housed in a steel container so that the chemical reaction may include the container. The fuel line may lead to, for example, an internal combustion engine, a boiler or a furnace.

Preferably, the fuel additive and the magnet are located in a container and in use are immersed in fuel flowing through the container. The container may be formed as a cylinder whose ends are closed apart from an inlet and an outlet for attachment to a fuel line. The fuel additive and the magnet may be further provided in combination with a steel member.

The fuel additive may be formed by, for example, casting, extruding, cutting or shaping to have the shape of, for example, a mesh, rod, plate, ball or tube. The fuel additive may be formed separately from other components. Alternatively, the fuel additive may be formed integrally with a component such as a fuel filter. It is presently preferred that the fuel additive is cast into the shape of a cone. It is also presently preferred that the fuel additive consists of, apart from impurities, 60 to 80% wt (pref. 70 to 75% wt) tin;

15 to 30% wt (pref. 15 to 25% wt) antimony;

2 to 7% wt (pref. 2 to 4% wt) lead; and 3 to 12% wt (pref. 3 to 7% wt) mercury.

In one embodiment, the apparatus of the present invention comprises a container formed as a steel cylinder whose ends are closed apart from an inlet and an outlet for attachment to a fuel line, the container housing a fuel additive located within the magnetic field of a magnet, with the fuel additive being provided by a line of a plurality of single identical solid members made from a formulation of metals, and the magnet being provided by a permanent ferrite magnetic member located nearer to the outlet than the inlet, the fuel additive being located nearer to the inlet than the outlet.

In another embodiment, the apparatus of the present invention comprises a container formed of plastics material as a cylinder whose ends are closed apart from an inlet and an outlet for attachment to a fuel line, the container housing a fuel additive located within the magnetic field of a magnet, with the fuel additive being provided by a plurality of layers each including a plurality of identical solid members made from a formulation of metals, and the magnet being provided by a plurality of permanent ferrite magnetic members held apart from one another by non-magnetic spacer members, the layers being separated at least from one another by a least one steel member, with the fuel additive being located nearer to the inlet and the magnet being located nearer to the outlet.

Although the precise technical details are not known, it is possible that a chemical reaction takes place between the fuel additive and the fuel and that the products of the chemical reaction are traced into the fuel in minute molecular form, and that the magnetic field alters the electrostatic charge on the products of the chemical reaction with the effect of improving fuel combustion efficiency.

Apparatus in accordance with the present invention will now be described in greater detail, by way of example only, with reference to the accompanying drawings in which.

Figure 1:
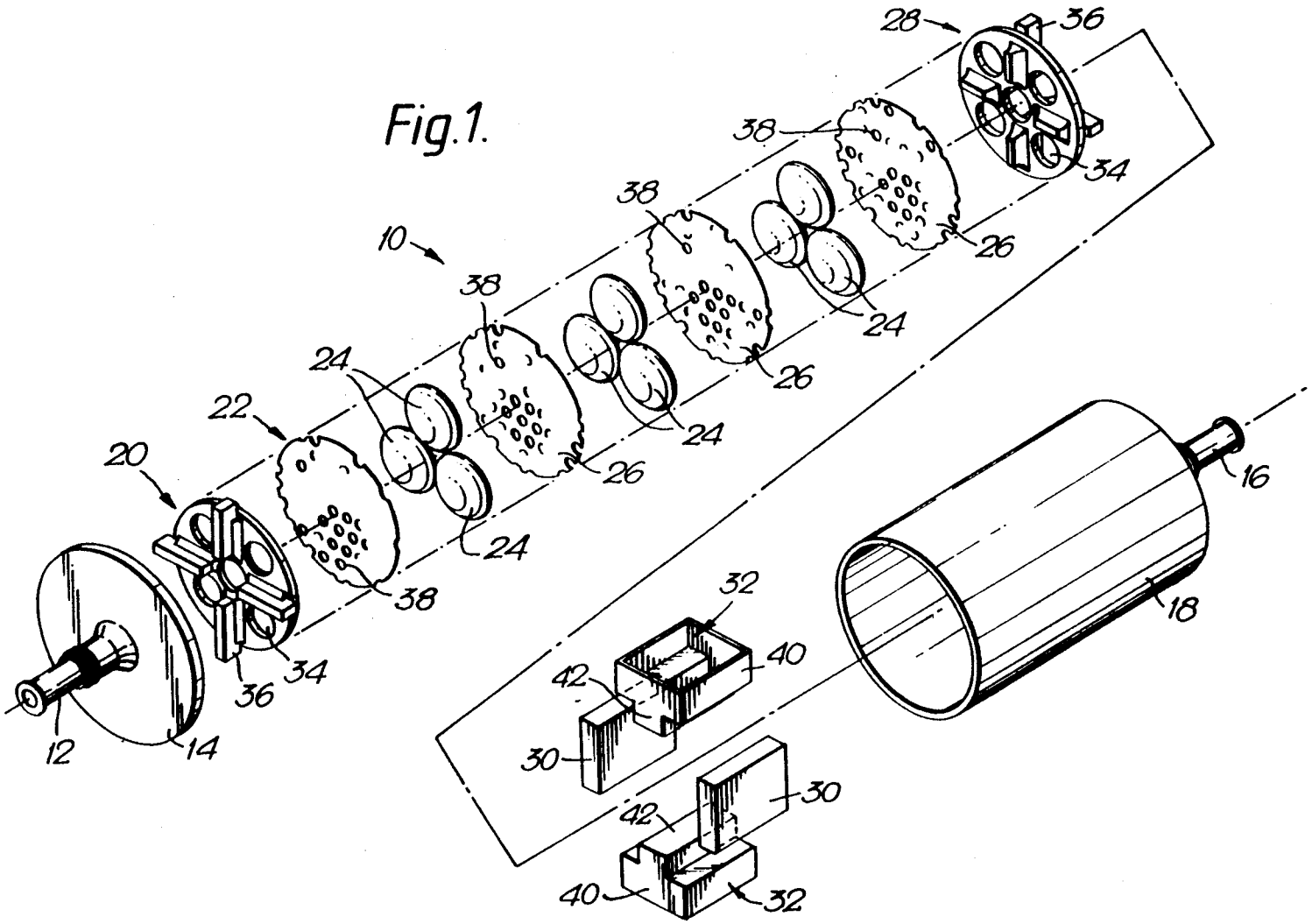
FIG. 1 is an exploded perspective view of the apparatus.
Figure 2:
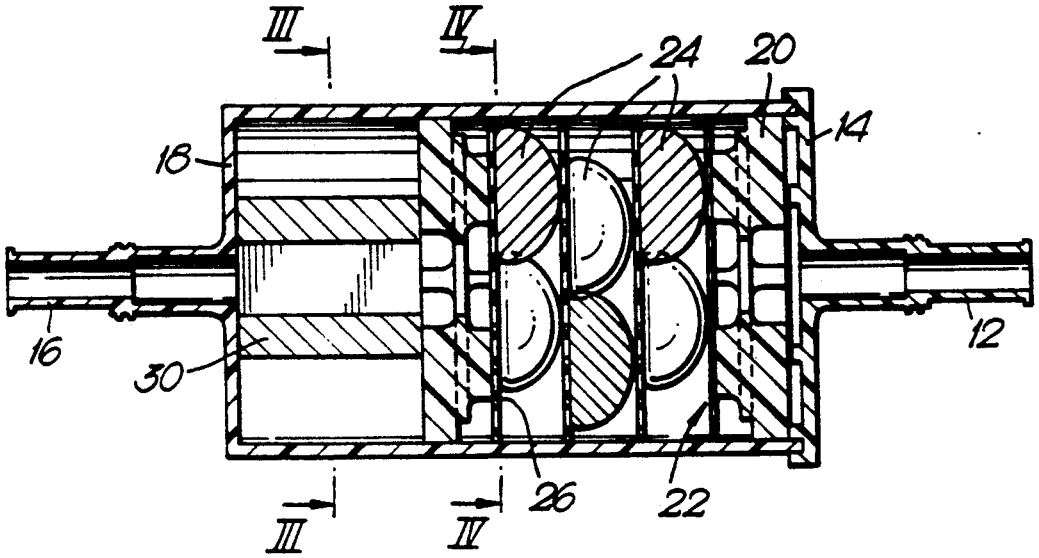
FIG. 2 is a longitudinal section through the apparatus.
Figure 3:
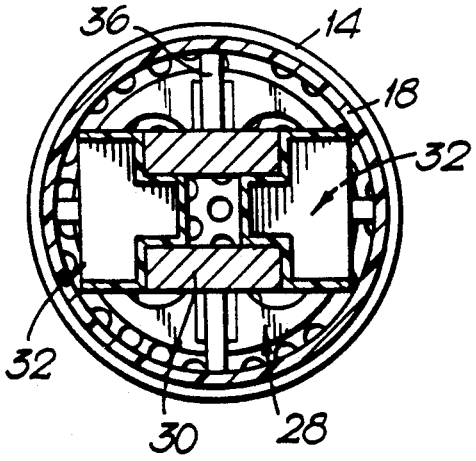
FIGS. 3 and 4 are, respectively, cross-sectional views through the apparatus taken along the lines III—III and IV—IV of FIG. 2.
Figure 4:
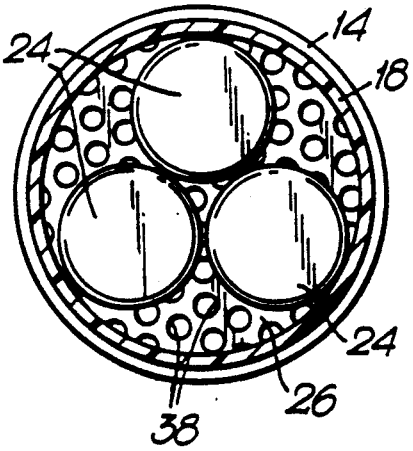

In the accompanying drawings, a cylindrical two-part container 10 of plastics material is provided with a fuel inlet 12 at one end in a lid part 14 and a fuel outlet 16 at the other end in a body part 18, the lid part 14 being sealingly secured to the body part 18 by for example ultrasonic welding.

In passing through the container 10, the fuel sequentially passes through a plastics spacer 20 adjacent a mild steel mesh disc 22, three sets of three cones 24 adjacent a further three mild steel mesh discs 26, another plastics spacer 28, and a pair of permanent ferrite magnets 30 held in parallel relationship by a pair of magnet spacers 32 of plastics material.

The cones 24 are identical, each of the cones 24 having a base diameter of approximately 20 mm and having a formulation of, apart from impurities, 70 to 75% wt tin, 15 to 25% wt antimony, 2 to 4% wt lead and 3 to 7% wt mercury. The cones 24 together constitute a fuel additive. Although nine cones 24 have been indicated, the particular number required naturally depends upon the particular application.

It will be noted that the fuel additive constituted by the cones 24 is located within the magnetic field of the permanent ferrite magnets 30.

It will also be noted that each of the plastics spacers 20 and 28 is formed as a circular disc with apertures 34 and ribs 36, each of the mesh discs 22 and 26 is formed as a generally circular plate with perforations 38, and that each of the plastics spacers 32 is formed as a rectangular block 40 with rib 42.

In an internal combustion engine, it is found that there is a smoother more efficient and reliable engine which lasts longer, the engine oil lasting longer and the carbon monoxide, nitric oxide and particulates in the exhaust emissions being reduced.

I claim:

1. An apparatus, for improving the efficiency of fuel combustion, comprising a magnet and fuel additive located within close combination within a container through which fuel flows such that at least the fuel additive is in contact with the fuel, the fuel additive consisting of, apart from impurities, 60 to 80% wt tin, 15 to 30% wt antimony, 2 to 7% wt lead and 3 to 12% wt mercury.

2. An apparatus according to claim 1, wherein the container is formed as a cylinder whose ends are closed apart from an inlet and an outlet for attachment to a fuel line, the fuel additive being located nearer to the inlet than to the outlet, and the magnet being located nearer to the outlet than to the inlet.

3. An apparatus according to claim 2, wherein the fuel % wt tin, 15 to 25% wt antimony, 2 to 4% wt lead and 3 to 7% wt mercury apart from impurities.

4. An apparatus according to claim 2, wherein the fuel additive comprises a line of a plurality of single identical solid members, and the magnet comprises a permanent ferrite magnetic member.

5. An apparatus according to claim 2 the fuel additive being provided by a plurality of layers each including a plurality of identical solid members, and the magnet being provided by a plurality of permanent ferrite magnetic members held apart from one another by non-magnetic spacer members, the layers being separated at least from one another by at least one steel member.

6. An apparatus according to any one of the claims, said apparatus being preceding located in a fuel line leading to an internal combustion engine.

* * * * *

UNITED STATES PATENT AND TRADEMARK OFFICE

CERTIFICATE OF CORRECTION

PATENT NO. : 5,249,552

DATED : Oct. 5, 1993

INVENTOR(S) : Douglas M. Brooks

It is certified that error appears in the above-identified patent and that said Letters Patent is hereby corrected as shown below:

Col. 3, line 10, after "and", insert --a--;

Col. 3, line 14, delete ", apart from impurities,";

Col. 3, line 16, after "mercury", insert --, apart from impurities--.

Col. 4, line 4, after "fuel", insert --additive consists of 70 to 75--;

Col. 4, line 10, after "2", insert --,--;

Col. 4, line 17, after "the", insert --preceding--;

Col. 4, line 18, delete "preceding".

Signed and Sealed this

Twenty-first Day of June, 1994

*Attest:*

Bruce Lehman

BRUCE LEHMAN

*Attesting Officer*

*Commissioner of Patents and Trademarks*